United States Patent [19]

Fisher

[11] 4,073,102

[45] Feb. 14, 1978

[54] PREMANUFACTURED MODULAR TOWN HOUSE BUILDING CONSTRUCTION

[76] Inventor: John Sergio Fisher, 2102 Euclid Ave., Syracuse, N.Y. 13224

[21] Appl. No.: 364,808

[22] Filed: May 29, 1973

[51] Int. Cl.[2] ..... E04B 1/34

[52] U.S. Cl. ..... 52/79.13; 52/227; 52/262; 52/266; 52/271; 52/587

[58] Field of Search ..... 52/236, 79, 258, 285, 52/587, 583, 283, 271, 266, 262, 227, 228

[56] References Cited

U.S. PATENT DOCUMENTS

| | | | |
|---|---|---|---|
| 2,803,856 | 8/1957 | Kofahl et al. | 52/262 X |
| 3,254,458 | 6/1966 | Van Der Lely | 52/79 |
| 3,389,560 | 6/1968 | Zemsky | 52/587 X |
| 3,514,910 | 6/1970 | Comm | 52/236 X |
| 3,555,763 | 1/1971 | Bloxom | 52/583 |
| 3,562,979 | 2/1971 | Ali-Oglu | 52/236 X |
| 3,564,795 | 2/1971 | Henton | 52/227 X |
| 3,621,626 | 11/1971 | Tylius | 52/583 X |
| 3,643,390 | 2/1972 | Shelley | 52/227 X |
| 3,694,977 | 10/1972 | Verman | 52/79 |
| 3,703,058 | 11/1972 | Klett et al. | 52/79 |
| 3,710,527 | 1/1973 | Farebrother | 52/236 |
| 3,721,052 | 3/1973 | Boel | 52/236 X |
| 3,724,141 | 4/1973 | Kelleher | 52/236 X |
| 3,736,709 | 6/1973 | Koch | 52/236 |
| 3,742,660 | 7/1973 | Burweiler | 52/236 X |
| 3,758,998 | 9/1973 | Ollis et al. | 52/79 |
| 3,775,928 | 12/1973 | Dawson et al. | 52/285 X |

FOREIGN PATENT DOCUMENTS

| | | | |
|---|---|---|---|
| 1,937,365 | 1/1970 | Germany | 52/79 |
| 530,372 | 7/1955 | Italy | 52/236 |
| 40,879 | 3/1956 | Poland | 52/79 |
| 330,735 | 6/1958 | Switzerland | 52/583 |
| 459,539 | 9/1968 | Switzerland | 52/79 |

*Primary Examiner*—Leslie Braun

*Attorney, Agent, or Firm*—Owen, Wickersham & Erickson

[57] ABSTRACT

A modular building construction system having (a) a series of rectangular U-shaped in vertical cross-section modules, each having only two bearing walls opposite each other and joined by a floor panel and open on top, and (b) a series of rectangular tube-shaped in vertical cross-section modules, each having only two bearing walls opposite each other and joined by both a floor panel and a ceiling panel. The tube-shaped modules are used only on the top story, and the U-shaped modules are used generally as lower units. The modules on each level are installed end to end so as to form a continuous living space in the longitudinal direction and side by side so as to form a separate series of living spaces and double walls separating the living spaces in the transverse direction.

5 Claims, 22 Drawing Figures

FIG. 8.
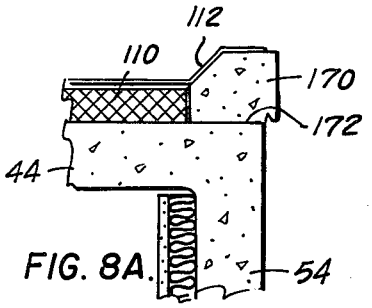
FIG. 8A.
FIG. 8B.
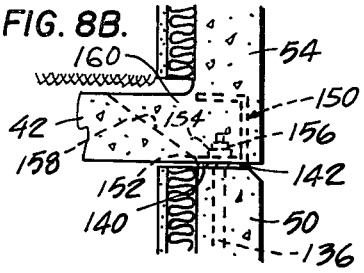
FIG. 8C.
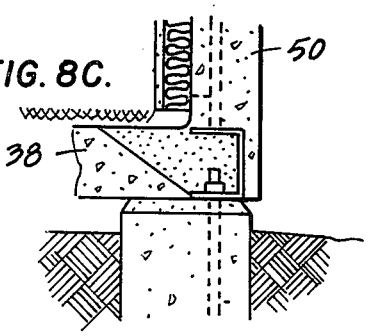
FIG. 8D.
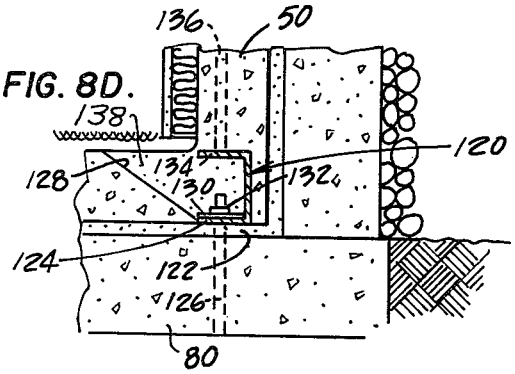
FIG. 7.
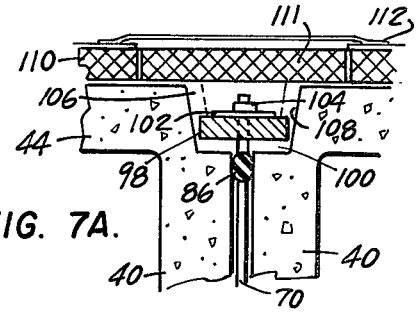
FIG. 7A.
FIG. 7B.
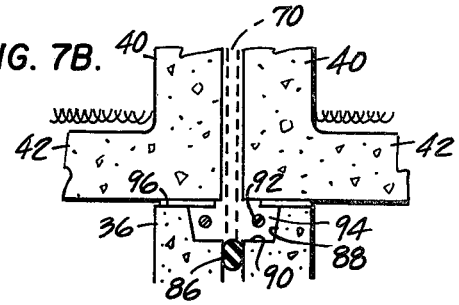
FIG. 7C.
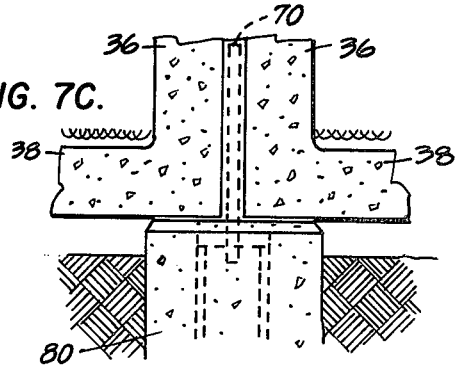
FIG. 7D.
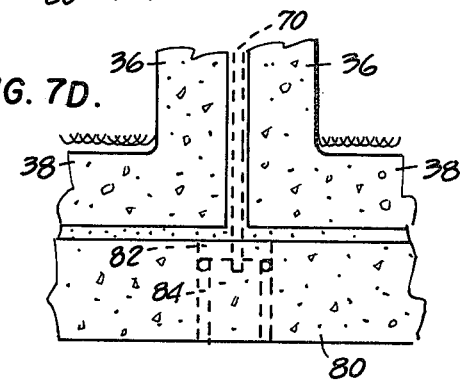

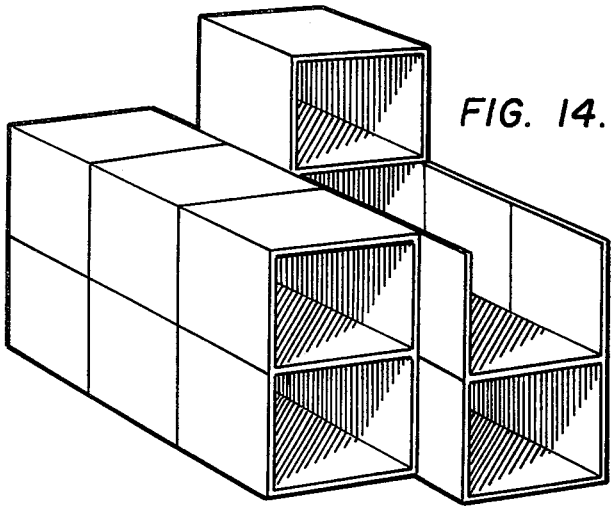
FIG. 14.
FIG. 9.
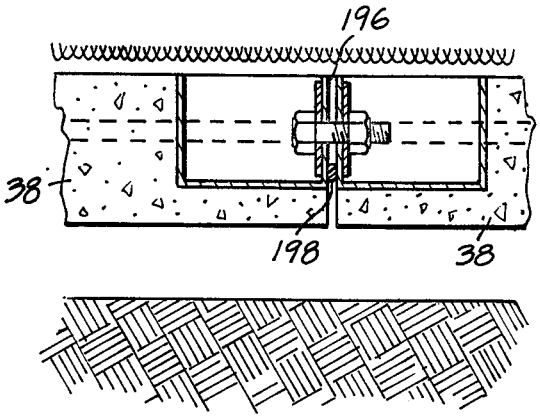
FIG. 12.
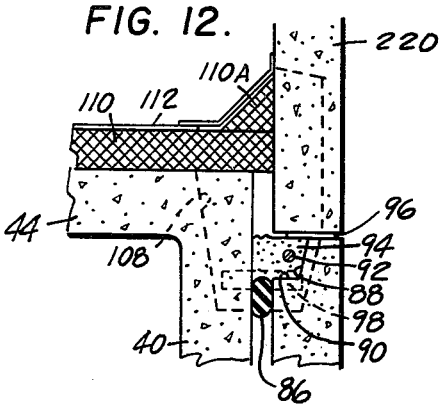
FIG. 10.
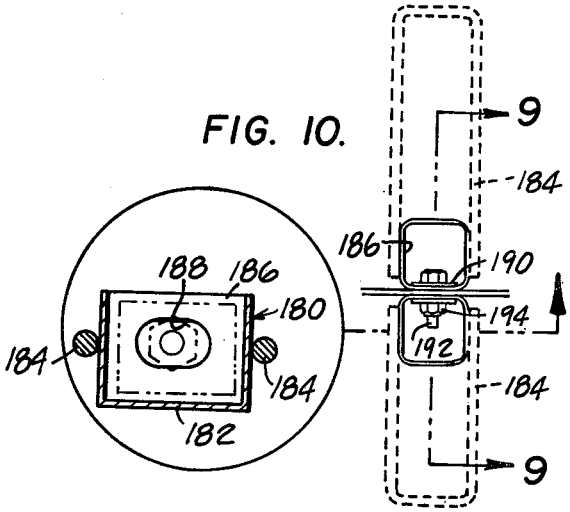
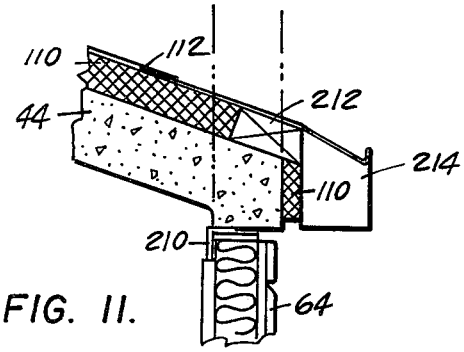
FIG. 11.
FIG. 13.
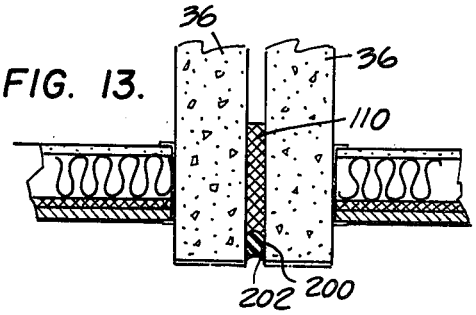

PREMANUFACTURED MODULAR TOWN HOUSE BUILDING CONSTRUCTION

BACKGROUND OF THE INVENTION

This invention relates primarily to town house construction employing three-dimensional modules. It also applies to other types of housing plus educational, community and office facilities.

Government housing experts have stated that this nation's projected demand for twenty-six million housing units over the next ten year period can be achieved, if at all, only through industrialized or factory-produced housing. Many manufacturers who are aware of this have been developing, and some have already built, particular kinds of industrialized housing units, each of which, no matter what the material, can be generally characterized as belonging to one of three basic structural or envelope systems or to combinations of them:

(1) skeletal, with components (structural frame with in-filled non-bearing wall panels);

(2) panel, with components (structural floor and wall panels);

(3) three dimensional or modular, with or without major components (boxes or sections of houses or buildings).

Of these three, modular systems allow the most work to be done in the factory and necessitate the least amount of work in the field, and the present invention relates to a basically modular system. Factory premanufacturing and pre-finishing can be most completely realized by the modular system, and to do so has many advantages. For one thing, factory wages are substantially less than field wages. Also, a factory generally offers better working conditions and can accommodate year-round work. Further, factory work can have a one-shop jurisdiction, which can mean more efficient operation, because any one man is able to do more than one task. In addition, assembly line efficiency is greater than on-site work.

Most multi-family modular systems in use today call for the units to be partially or fully pre-finished in the factory, so that interior partitions, doors, fixtures, equipment, windows, etc., are installed in the modules in the factory. However, when the fully pre-finished modules have heretofore been assembled into a building, assembly has resulted in non-functional redundancy of materials, i.e., double walls or double floors within the same living unit where it has not been functionally needed. Cost estimates indicate that this redundancy typically adds to the cost 80¢ to $1.60 per square foot of floor area, depending upon the system and the area. Moreover, most of such systems have been based upon a mobile home sectionalized unit, — a very inflexible system for different unit distributions and packing possibilities.

On the other hand, where heretofore attempts have been made to eliminate redundancy, wherein modules are stacked in an alternated or checkerboard pattern, developing so-called "free spaces," it has been very difficult to finish the free spaces at the factory, and as a result, the cost of on-site finishing has been increased by approximately $1.00 to $2.00 per square foot. Futhermore, such systems when applied to townhouses either over design their interior unit walls or must add material to their unit party walls in order to achieve satisfactory noise and fire retardation performance specifications. Also, the economic need to have bathroom and kitchens in modules rather than as "free" spaces, so that they could be preassembled, has been a restraint on the flexibility of these non-redundant systems heretofore available.

SUMMARY OF THE INVENTION

This system of the present invention solves the problem of but is not limited to the optimizing town house construction by optimizing factory prefinishing by being a total module system and by eliminating non-functional redundancy of walls or floors and by simultaneously providing proper acoustical and fire protection at party walls between two houses.

A town house is defined as a living unit having more than one level connected by interior stairs whether it be on the ground attached or detached and whether it be below or above other living units or other spaces. This invention is also applicable to apartment flats stacked up to 24 stories.

In this invention, a basic plan element consists of a rectangular module the width of a town house unit. The constraints on the lateral dimension and height of this module come from shipping problems, i.e., the maximum size under which is economically allowable under the trucking law of the state or states where the module is to be transported. The module can have any width up to 60 feet depending upon structural constraints but will generally vary from 12 feet to 28 feet 8 inches in width. When the module must be shipped by rail or truck, its lateral dimension cannot exceed the state shipping width limitation which is 12 feet in most states but 14 in others. In cases where it may be economical to ship by helicopter, there is less constraint on the shape and plan size.

The system of this invention employs two basic elements which are added to, filled into, and embellished, all as called for by the particular plan they are employed in. These two basic elements are:

(a) a first type of rectangular module, having two parallel bearing walls across the width and joined together by a floor. The two opposite ends in the longitudinal direction are either open or have non-bearing walls. From the standpoint of bearing walls, this type of module can be formed "U-shaped" or "U-shaped in vertical cross-section."

(b) a second type of rectangular module differing from the first module, having a roof system or ceiling panel, in addition to the two bearing walls on opposite sides, the two open or non-bearing ends, and the floor. From the standpoint of bearing walls this second module may be termed "tubular" or "tube shaped in vertical cross-section."

The first or U-shaped module has no roof or ceiling. It can be braced during transportation. When the system of this invention is used in wood buildings up to four stories high, depending upon governing codes, the U-shaped module is used only on the lower stories. The top story necessitates the other basic element, the tube-shaped module.

When these two basic modules are packed together to build the final structure, both the tube-shaped module and the U-shaped module are the full width of the housing unit with no double walls within the unit and parallel to each other on any one floor, so that there are double fire and noise separation walls between units. Moreover the space between the double walls becomes a chase for structurally tying the building together by post tensioning. Moreover, when placing either a U-shaped module or a tube-shaped module upon a U-shaped module, there are no double floors. This avoidance of redundancy in housing units by mating and placing U-shaped and tube-shaped modules is a basic principle by which great economy and flexibility can be achieved.

The fact that the module can be adjusted to various sizes further increases its flexibility. The modules are prefinished as much as possible in the factory; exactly how much depends upon the specific manufacturer and on the governing codes and union agreements.

The four main objectives of the system of this invention are (1) to maximize the factory work, (2) to minimize field work, (3) to eliminate non-functional redundancy of materials, and (4) to allow for infinite flexibility of planning possibilities. The basic characteristics of the system are (1) the use of tube-shaped modules on top of one or more levels of U-shaped modules, and (2) that these U-shaped and tube-shaped modules are the full width of a townhouse living unit and are stacked side by side for environmental control separation.

The modules of this invention are easily lifted by helicopter, are easily transportable by truck and train, and are easily set in place by a light crane; they are economical, flexible elements. The simple concept of this system can be organized to conform to any way of living. Although this system is invented for one-, two-, three-, four-, and five-bedroom town houses and from one to 24 stories, depending on the structural material, whether it be wood, concrete, metal or plastic, the illustrations contained herein show the principle applied to a specific design for a two-bedroom town house which meets HUD and FHA requirements with details for concrete construction. This system also applies to detached single story dwellings, flats and non-residential applications.

Other objects and advantages of the invention will appear from the following description of a preferred embodiment, given as an example and in no way intended to limit the invention to a particular material, a particular height or size of building, to any particular floor plan or exterior design, or to a particular type of house.

BRIEF DESCRIPTION OF THE DRAWINGS

FIG. 5 and FIG. 6 show a part of a party wall of an adjacent town house unit and post tensioning strands located between the adjacent party walls and illustrated in greater detail in FIG. 7;

FIG. 7 is a series of views showing details of party wall connections;

FIG. 7A shows the party wall connection at the roof;

FIG. 7B shows the party wall connection at the second or third floor;

FIG. 7C shows the party wall connection at grade;

FIG. 7D shows the party wall connection below grade;

FIG. 8 is a series of views showing end wall constructions for the modules;

FIG. 8A shows the module end wall construction at the roof;

FIG. 8B shows the module end wall connection at the second or third floor level;

FIG. 8C shows the module end wall construction at grade;

FIG. 8D shows the module end wall construction below grade;

FIG. 9 is an elevation view in section taken along the line and in the direction indicated by the arrows 9—9 in FIG. 10 and shows the connection between the floor slabs of two longitudinally aligned modules at or below grade;

FIG. 10 is a fragmentary enlarged plan view showing details of a module to module connection box;

FIG. 11 is an enlarged fragmentary view of section of a part of a living unit shown encircled by the arrows 11—11 in FIG. 4;

FIG. 12 is an enlarged, fragmentary view in section showing details of a roofline construction between adjacent town house living units at the point indicated generally by the encircled arrows 12—12 in FIG. 4;

FIG. 13 is an enlarged, fragmentary plan view in cross-section showing details of a party wall exterior connection between adjacent town house units;

FIG. 14 is a diagrammatic isometric view showing one additional specific combination of U-shaped and tube-shaped modules in side by side living units constructed in accordance with a further embodiment of the present invention.

DESCRIPTION OF THE PREFERRED EMBODIMENT

Figure 1:
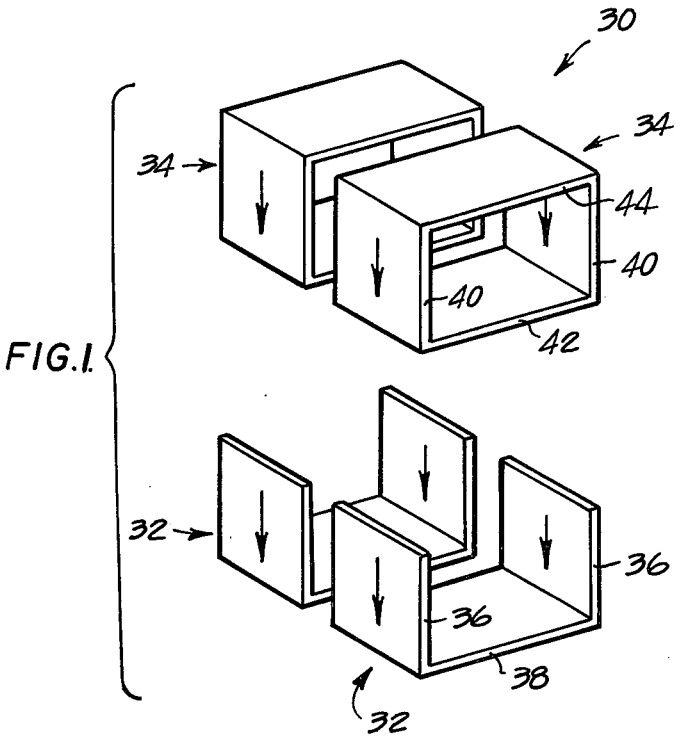
FIG. 1 is a diagrammatic isometric view, partially exploded, showing how a living unit is constructed with lower level U-shaped modules and upper level tube-shaped modules in accordance with one embodiment of the present invention. The arrows indicate load-bearing walls.

FIGS. 1 and 14 illustrate in diagrammatic form how living units are constructed and arranged side by side in accordance with the present invention.

The exploded showing of FIG. 1 illustrates how the two basic modules of the present invention are positioned with respect to one another to construct an individual living unit.

FIG. 14 illustrates two of the many forms that each individual living unit may take, and FIG. 14 also illustrates how individual living units may be placed side by side to obtain a wide variety of paired groupings of individual living units in accordance with the present invention.

FIGS. 2–6 show, in some detail, how two individual town houses are constructed and arranged side by side in accordance with the present invention.

FIGS. 7–13 show structural details of portions of and connections between the modules of the two specific individual town houses shown in FIGS. 3–6.

An individual living unit constructed in accordance with one embodiment of the present invention is indicated generally by the reference numeral 30 in FIG. 1. The lower level of the living unit 30 is made up of one or more rectangular modules 32 which are U-shaped in vertical cross-section.

The top level of the living unit 30 is always made up of one or more rectangular modules 34 which are tube shaped in vertical cross-section.

The modules 32 and 34 are prebuilt an prefinished in a factory and are assembled together in the field to make the living unit 30. Each module 32 and 34 is preformed and may be made of wood or concrete or other materials.

In all cases the modules extend the full width of the living unit, and each module has two parallel extending and laterally spaced apart load-bearing walls connected integrally to a floor slab.

Thus, the U-shaped modules 32 have vertically extending load-bearing walls 36 connected to the floor slab or panel 38.

The tube-shaped modules have load-bearing sidewalls 40 connected to the floor slab or panel 42.

By having the load bearing walls located at the sides of the modules and connected integrally to the floor, redundancy of interior walls is eliminated.

Because the U-shaped modules 32 used for the lower levels are open at the top, redundancy of floor and ceilings is also eliminated.

Figure 4:
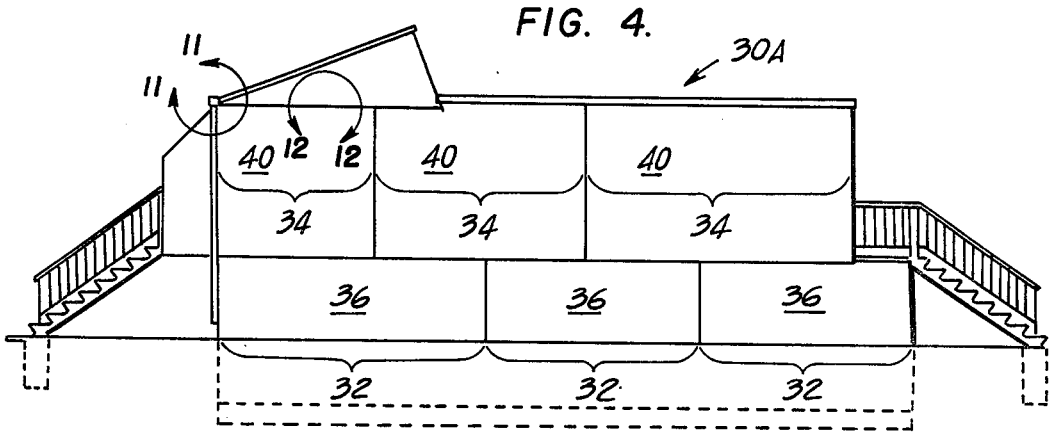
FIG. 4 is a side elevation view taken along the line and in the direction indicated by the arrows 4—4 in FIG. 3.

As best illustrated in the side elevation view of FIG. 4, a specific town house living unit 30A is made by aligning three U-shaped modules 32 end to end in longitudinal alignment on the lower level and placing three tube shaped modules 34 end to end in longitudinal alignment on the tops of the U-shaped modules 32.

FIG. 4 also illustrates how the individual modules can be of varying lengths to accommodate different architectural styles and to provide variation in side by side town house units. The U-shaped module 32 at the left end of FIG. 4 may be 15 feet in length while the other two U-shaped modules 32 are 12 feet in length. The tube-shaped module 34 at the right end of FIG. 4 may be 15 feet in length while the center tube-shaped module 34 is 12 feet in length and the tube-shaped 34 at the left side of FIG. 4 may be slightly over 8 feet in length.

The U-shaped modules and the tube-shaped modules at the ends of the individual town house living units 30A and 30B have non-load bearing walls 50, 52, 54 and 56 for the town house 30B and 60, 62, 64, and 66 for the town house 30A.

Figure 6:
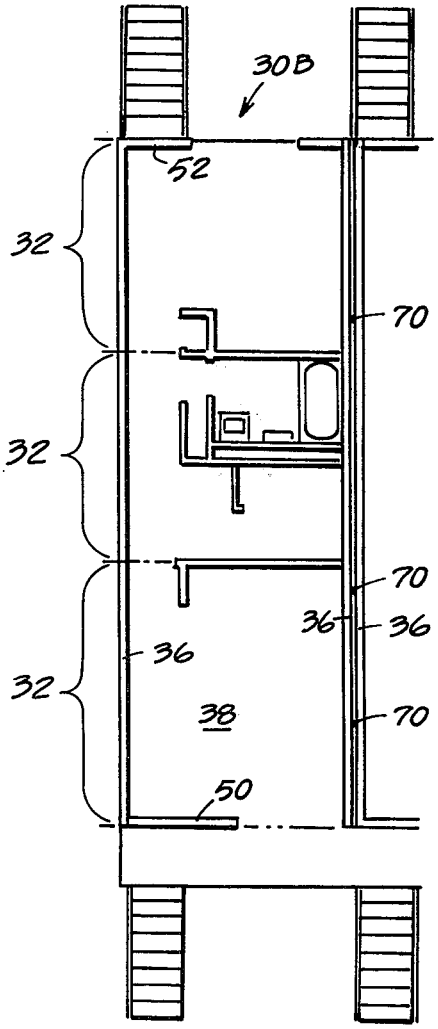
FIG. 6 is a plan view of a lower level of a two-bedroom town house living unit constructed in accordance with the present invention. Both
Figure 5:
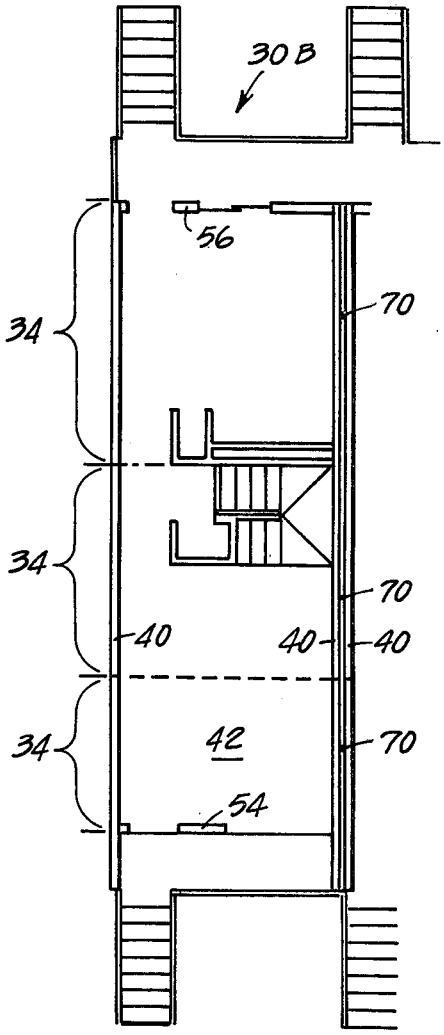
FIG. 5 is a plan view of an upper level for a two-bedroom town house living unit constructed in accordance with the present invention.

As illustrated in FIGS. 5 and 6, and as will be described in greater detail below with reference to FIGS. 7A–7D, a series of post tensioning strands 70 are positioned between the party walls 40 of the adjacent town house living units 30A and 30B.

Vertically adjacent U-shaped and tube-shaped modules are connected together by the structure illustrated in FIG. 7.

Longitudinally aligned and horizontally adjacent modules, whether U-shaped or tube-shaped, are connected together by the connection shown in FIG. 9.

The end walls are connected to the modules by the structure shown in FIG. 8.

FIGS. 11 and 12 show details of two roof connections.

Figure 3:
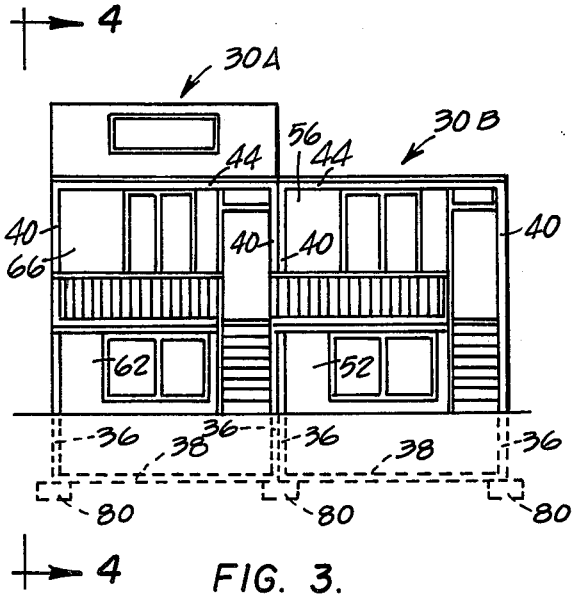
FIG. 3 is a back elevation view of the two town house living units shown in FIG. 2.
Figure 2:
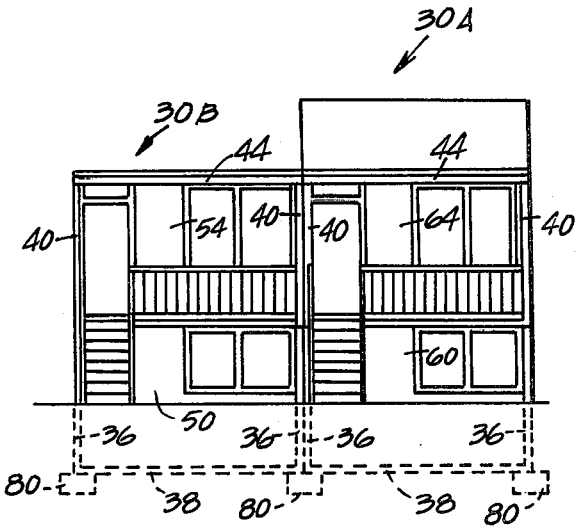
FIG. 2 is a front elevation view showing two side by side town houses each constructed in accordance with an embodiment of the present invention.

The town house units 30A and 30B illustrated in FIGS. 2 and 3 incorporate modules of cast concrete and are built with the lower level partly under grade.

The floor slab 38 rests on a series of blocks forming a footing or foundation wall 80.

As illustrated in FIGS. 7C and 7D the connection of the post tensioning strand 70 to the foundation 80 is the same, whether the foundation is above or below grade.

As illustrated in FIGS. 7C and 7D, the footing 80 has a threaded plate 82 with reinforcing bars 84 welded to the bottom side of the plate and embedded in the concrete of the footing 80. The lower end of the strand 70 is threaded into the plate 82 to hold that end securely in position. The strand 70 extends upward through the small air space between the adjacent party walls 36 of the U-shaped modules; and, as illustrated in FIGS. 7B and 7A, on upward through the small air space between adjacent party walls 40 of the tube-shaped modules.

A polystyrene rod 86 is positioned between the upper edges of the load bearing, adjacent party walls 36 of the U-shaped modules as illustrated in FIG. 7B to maintain the small air space between these adjacent walls, and a similar polystyrene rod 86 is positioned between the upper edges of the adjacent load bearing party walls 40 of the tube-shaped modules as illustrated in FIG. 7A.

As illustrated in FIG. 7B, the outside edge of each wall 36 is formed with a laterally offset surface 88 and a vertically offset surface 90 to form a recess as illustrated for a reinforcing bar 92 which extends along the length of each town house unit at the upper edge of each U-shaped module to help retain, in combination with the grout 94 shown cast about the reinforcing bar 92, modules 36 in longitudinal alignment and in end engagement. The connector shown in FIGS. 9 and 10 also connects the ends of the modules.

A bearing plate 96 rests on the top surface of the wall 36 and grout 94 and engages the bottom surface of the slab 42 at the junction of these two surfaces.

As illustrated in FIG. 7A, the top end of the strand 70 extends through a plate 98. The plate 98 rests on a layer of grout 100. A washer 102 and a nut 104 are used to tension the strand 70 against the plate 98, and a quantity of grout 106 is then placed in the top part of the cavity formed by the laterally recessed surface 108 and the vertically recessed surface at the top edge of each tube-shaped module.

A layer of insulation 110 extends across the top of each ceiling panel 44.

Field applied neoprene and hypalon coatings 112 provide the top part of the roofing surface.

A strip of insulation 111 is placed between the layers of insulation 110 at the juncture of the top surfaces of the adjacent tube shaped modules, and the neoprene and hypalon coatings 112 are extended over this strip of insulation 111 to seal the roof at these junctures.

With reference to FIG. 7B, the under surface of the panel 42 of the tube-shaped module 34 is prefinished with a textured surface or other desired surface to form the ceiling for the room beneath the panel 42 and within the lower U-shaped module. The top surface of the panel or slab 42 is prefinished with carpeting or other floor surface for the room above the panel.

FIGS. 8A–8D show the connecting arrangements for module end walls from the roof down to below grade.

Looking first at FIG. 8D, the end wall 50 is connected to the foundation 80 by a connection box 120. A layer of grout 122 is placed on top of the foundation 80 and the lower flange 124 of the connection box 120 is placed over the threaded end of a reinforcing rod 126 cast into the footing 80.

The space within the interior of the connection box 120 is open at this time, and the forward edge of the floor panel 38 of the U-shaped module 32 is recessed at an angle as indicated by the surface 128 to provide access to the interior of the box 120. A washer 130 and a nut 132 are placed over the threaded end of the reinforcing bar 126 and tightened down to pull the lower flange 124 of the box tight against the grout layer 122. An upper flange 134 of the connection box 120 is welded or otherwise suitably attached to the lower end of a dowel 136 cast into the end wall 50.

After the nut 132 has been tightened in place, grout 138 is used to fill in the interior of the connection box 120 and to level the junction of the end wall with the upper surface of the floor slab 38 as illustrated.

As illustrated in FIG. 8B, the upper end of the dowel 136 projects upwardly for a short distance above the upper edge of the end wall 50. This projecting end of the dowel is threaded and is used to make the connection to the end wall 54 for the tube-shaped module.

A neoprene pad is placed on top of the upper surface of the end wall 50 and over the projecting end of the dowel 136.

In the tube-shaped module shown in FIGS. 8A and 8B the end wall 54 is formed integrally with the module as illustrated, and the end wall 54 includes a connection box 150 which is similar to the connection box 120 described above with reference to FIGS. 8B and 8C. A lower flange 152 of the connection box 150 is placed over the projecting end of the dowel 136; and a washer 154 and nut 156 are used, as illustrated, to connect the connection box 150 and the end wall 54 to the dowel 136 and the end wall 50. The space within the connection box is open at this time and the front edge of the floor panel 42 is recessed at an angle as illustrated by the surface 158 to permit access to the interior of the connection box. After the connection has been made, grout 160 is filled in to the interior of the connection box and to level the floor surface up to the junction with the end wall 54.

A polypropelene caulking 142 is also used to caulk the joint between the top of the end wall 50 and the bottom of the end wall 54.

As illustrated in FIG. 8A, for decorative purposes a pre-cast parapet 170 is attached to the end wall 54 by epoxy glue 172.

The rigid insulation 110 extends behind the parapet and the neoprene and hypalon coatings 112 are applied in the field over the parapet and the insulation.

FIGS. 9 and 10 show details of the connection arrangement between the floor slabs of longitudinally aligned and adjoining modules.

The structure shown in FIGS. 9 and 10 will be described with reference to a connection between the floor slabs 38 of two U-shaped modules. However, the same connection is used for connecting the floor slabs 42 of the tube-shaped modules.

As illustrated in FIGS. 9 and 10 each floor slab 38 has a connection box 180 fixed in place at a plurality of locations along each end edge of the floor slab. The connection box 180 may be a section of a standard $4 \times 4 \times \frac{1}{4}$ inch hollow structural tube with a base plate 182 connected across one end of the tube section. Two of the sides of each connection box are welded or otherwise suitably attached to the adjacent ends of a U-shaped rod 184. The rod 184 is cast integrally in the floor slab 38. The outer sidewall 186 of each connection box has a slotted hole 188, as best illustrated in FIG. 10. Washers 190 are placed on the inside of each connection box and a threaded bolt 192 and nut 194 are used to connect the two connection boxes and the adjacent floor slabs 38 as illustrated.

As illustrated in FIG. 9 a thin layer of grout 196 is preferably placed between the walls 190 of the connection boxes and a small diameter polystyrene rod 198 is used to retain the grout in position while it is setting up.

FIG. 13 is a plan view showing how insulation 110 is placed between two adjacent party walls 36 in combination with a polystyrene rod 200 and polypropelene caulking 202. This insulation runs the full height of each module and the town house living unit and provides a finished appearance as well as desired insulation and acoustical properties by reason of the enclosed air space.

FIGS. 11 and 12 show details of roof constructions. FIG. 11 shows a roof construction at an end wall, and FIG. 12 shows a roof construction at a divider wall.

FIG. 11 shows a brick in-fill end panel 64 connected to a U-shaped module having a sloped roof 44 to provide a skylight arrangement like that shown for the town house living unit 30A of FIGS. 2 and 3.

The end wall 64 is connected to the ceiling panel 44 by a connecting bracket 210 having one leg attached to the panel 44 and having one leg attached to the panel 64.

The usual insulation 110 is placed on top of the roof panel 44, and a smaller strip of insulation 110 is placed on the outside end edge of the panel 44. A block 212 is attached to the roof panel 44, and flashing and a gutter 214 are connected to the block 212 as illustrated.

FIG. 12 illustrates a connection for connecting the top of a tube shaped module with a divider wall 220 which extends above the top of the U-shaped module.

A post tensioning strand 70 extends between the side wall 40 and the divider wall 220 in the same manner as the post tensioning strand 70 illustrated in FIG. 7A.

A polystyrene rod 86 maintains the desired spacing between these two walls, and the post tensioning strand 70 is tensioned by a plate 98, washer and nut arrangement in the same manner as illustrated and described with reference to FIG. 7A.

A reinforcing bar 92 extends longitudinally within a space formed by recessed surfaces 88 and 90 of the lower part of the lower section of the divider wall 220, and this reinforcing bar is grouted in by grout 94 in the same manner as described with reference to FIG. 7B. A neoprene pad 96 is then placed on top of the lower section of the divider wall 220 and the grout layer 94 and an upper section of the divider wall 220 is placed on top of the neoprene pad 96.

As illustrated, the upper part of the divider wall 220 extends above the top surface of the panel 44. The insulation 110 is engaged with the facing surface of the divider wall 220 as illustrated, and an angle piece 110A of insulation is positioned as illustrated. The neoprene and hypalon coatings 112 are then placed over the insulation 110 and 110A to seal the joint.

While the invention has been described in detail with respect to modules that are preformed of cast concrete, the principles of the invention are equally applicable to modules which are preformed from other materials, such as bricks and wood.

While the invention has also been illustrated and described with particular reference to a two-level town house, the manner of using the U-shaped modules and the tube-shaped modules for full width living units applies equally well to detached single story dwellings, to flats and to non-residential applications. Apartment flats stacked up to 24 stories can be made using the U-shaped module and the tube-shaped module structures and methods described above. In each case the module extends the full width of the individual unit and redundancy of bearing walls and floors and ceilings is eliminated. And in each case double fire and noise separation walls are provided between units. The avoidance of redundancy in the living units by mating and placing U-shaped and tube-shaped modules is the basic principle by which great economy and flexibility are achieved.

FIG. 14 illustrates one additional specific embodiment that the present invention may take. In FIG. 14 a three level unit is located side by side with a two level unit but in longitudinally offset relationship.

It will be apparent that many additional combinations of individual units can be produced while realizing the economic benefits and the aesthetic values of the present invention.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A building unit of the kind having more than one level and constructed in the field from modules which are preformed and prefinished in a factory, said building unit comprising, a plurality of lower level rectangular modules which and U-shaped in vertical cross-section, and are in longitudinal alignment, each said U-shaped module being the full width of the building unit and having two load bearing sidewalls laterally spaced apart at opposite sides of the building unit and extending along at least a part of the length of the building unit, said U-shaped module also having a floor connected to the lower edges of the sidewalls and having an open top, a plurality of upper level rectangular modules which are tube-shaped in vertical cross section and are in longitudinal alignment, positioned on the top of an uppermost U-shaped module, said tube-shaped module having two load bearing sidewalls vertically aligned with the U-shaped module sidewalls and having a floor connected to the lower edges of the sidewalls and a ceiling connected to the upper edges of the sidewalls, horizontal connecting means connecting the adjacent ends of the U-shaped modules together and also connecting the adjacent ends of the tube-shaped modules together, said horizontal connection means including a recess extending longitudinally along the outer upper edge of each longitudinally aligned sidewall, a reinforcing bar disposed in said excess and extending along the entire length of longitudinally aligned modules and grout connecting the reinforcing bar to each longitudinally aligned module sidewall, and vertical connecting means connecting all vertically aligned and adjacent modules together whereby the living unit has no double floors or ceilings, each of said load bearing sidewalls abutting at its lower edge directly upon the upper edge of the adjacent lower sidewall.

2. A building unit combination of the kind having more than one level and constructed in the field from modules which are preformed and prefinished in a factory, said building unit combination comprising a first building unit and including a second building unit positioned beside the first building unit, each said building unit comprising at least one lower level rectangular module which is U-shaped in vertical cross section, each said U-shaped module being the full width of the building unit and having two load bearing sidewalls laterally spaced apart at opposite sides of the building unit and extending along at least a part of the length of the building unit, said U-shaped module also having a floor connected to the lower edges of the sidewalls and having an open top, an upper level rectangular module which is tube-shaped in vertical cross section and positioned on the top of an uppermost U-shaped module, said tube-shaped module having two load bearing sidewalls vertically aligned with the U-shaped module sidewalls and having a floor connected to the lower edges of the sidewalls and a ceiling connected to the upper edges of the sidewalls, and vertical connecting means connecting all vertically aligned and adjacent modules together whereby the living unit has no double floors or ceilings, each of said load bearing sidewalls abutting at its lower edge directly upon the upper edge of the adjacent lower sidewall, said second building unit being located immediately adjacent the first building unit with the adjacent sidewalls of the first building unit and the second building unit forming double thick party walls for fire protection and noise separation between the building units, and spacer means between the side faces of the party walls for providing a small lateral space between the party walls and wherein the vertical connecting means include a plurality of longitudinally spaced and vertically extending tensioning strands and strand connecting means connecting each strand to the tops and to the bottoms of the adjacent building units.

3. The invention defined in claim 2 wherein the spacer means include horizontal polystyrene rods extending longitudinally along the length of each party wall, vertical polystyrene rods extending vertically along the edge of each party wall and sealing means around the polystyrene rods forming a sealed air space between each party wall.

4. A building unit of the kind having more than one level and constructed in the field from modules which are preformed and prefinished in a factory, said building unit comprising, at least one lower level rectangular module which is U-shaped in vertical cross section, each said U-shaped module being the full width of the building unit and having two load bearing sidewalls laterally spaced apart at opposite sides of the building unit and extending along at least a part of the length of the building unit, said U-shaped module also having a floor connected to the lower edges of the sidewalls and having an open top, an upper level rectangular module which is tube-shaped in vertical cross section and positioned on the top of an uppermost U-shaped module, said tube-shaped module having two load bearing sidewalls vertically aligned with the U-shaped module sidewalls and having a floor connected to the lower edges of the sidewalls and a ceiling connected to the upper edges of the sidewalls, and vertical connecting means connecting all vertically aligned and adjacent modules together whereby the living unit has no double floors or ceilings, each of said load bearing sidewalls abutting at its lower edge directly upon the upper edge of the adjacent lower sidewall, at least some of the modules having end walls but all such end walls being non-load bearing walls, said end walls having connection boxes located along the lower edge of the end wall, each connection box being attached to reinforcing rods which are cast in place in the end wall, the ends of the module floors having recessed edges to accommodate fit-up with the connection boxes.

5. The invention defined in claim 4 including dowels projecting upwardly from foundations and the upper surfaces of end walls at locations corresponding to locations of the connection boxes, each dowel having a threaded end for a nut which connects the boxes to the dowels.

* * * * *

UNITED STATES PATENT AND TRADEMARK OFFICE

CERTIFICATE OF CORRECTION

PATENT NO. : 4,073,102

DATED : February 14, 1978

INVENTOR(S) : John Sergio Fisher

It is certified that error appears in the above-identified patent and that said Letters Patent are hereby corrected as shown below:

Column 2, line 13, "two houses" should read --town houses--.

Column 4, line 28, "view of section" should read --view in section--.

Column 9, line 32, "and U-shaped" should read --are U-shaped--.

Column 9, line 58, "excess" should read --recess--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*